US009963860B2

(12) United States Patent
Blum

(10) Patent No.: US 9,963,860 B2
(45) Date of Patent: May 8, 2018

(54) SANITARY INSERT UNIT

(71) Applicant: Neoperl GmbH, Mullheim (DE)

(72) Inventor: Gerhard Blum, Gutach (DE)

(73) Assignee: NEOPERL GMBH, Mullheim (DE)

( * ) Notice: Subject to any disclaimer, the term of this patent is extended or adjusted under 35 U.S.C. 154(b) by 0 days. days.

(21) Appl. No.: 15/485,798

(22) Filed: Apr. 12, 2017

(65) Prior Publication Data

US 2017/0268210 A1 Sep. 21, 2017

Related U.S. Application Data

(62) Division of application No. 15/052,093, filed on Feb. 24, 2016.

(30) Foreign Application Priority Data

Mar. 9, 2015 (DE) ..... 20 2015 001 886 U

(51) Int. Cl.

| | |
|---|---|
| ***E03C 1/08*** | (2006.01) |
| ***E03C 1/084*** | (2006.01) |
| ***E03C 1/086*** | (2006.01) |
| ***E03C 1/00*** | (2006.01) |

(52) U.S. Cl.

CPC ..... *E03C 1/084* (2013.01); *E03C 1/00* (2013.01); *E03C 1/086* (2013.01)

(58) Field of Classification Search

CPC ..... E03C 1/084; E03C 1/086; E03C 1/10
USPC ..... 239/428.5, 590, 590.3, 590.5, 553.3
See application file for complete search history.

(56) References Cited

U.S. PATENT DOCUMENTS

| | | | | |
|---|---|---|---|---|
| 5,769,326 | A | 6/1998 | Muchenberger et al. | |
| 2002/0084353 | A1 | 7/2002 | Griffin et al. | |
| 2003/0141384 | A1 | 7/2003 | Grether et al. | |
| 2009/0008478 | A1 | 1/2009 | Grether | |
| 2009/0224067 | A1* | 9/2009 | Grether | E03C 1/084 239/106 |
| 2010/0065661 | A1* | 3/2010 | Grether | E03C 1/084 239/428.5 |

(Continued)

FOREIGN PATENT DOCUMENTS

| | | |
|---|---|---|
| DE | 19510734 | 9/1996 |
| DE | 102005042212 | 8/2006 |

(Continued)

*Primary Examiner* — Arthur O Hall
*Assistant Examiner* — Joel Zhou
(74) *Attorney, Agent, or Firm* — Volpe and Koenig, P.C.

(57) ABSTRACT

A sanitary insert unit is provided having a jet regulator which has a housing with a housing inlet and a housing outlet, and a jets splitter in the housing interior. The jet splitter protrudes partially into a diffuser ring, delimiting an annular channel therebetween. The diffuser ring is insertable into an outlet-side housing part of the housing until an annular step on the outer circumference of the diffuser ring bears on an inlet-side mating surface on an outlet-side housing part. A circumferential locking cam on an outer circumference of the diffuser ring is movable into locking engagement with a locking groove provided on an inner circumference of the outlet-side housing part. The locking cam has a run-on bevel which interacts with a mating bevel upstream from the locking groove in an insertion direction that has a greater angle of inclination with respect to a longitudinal axis in comparison with the run-on bevel.

8 Claims, 3 Drawing Sheets

(56) References Cited

U.S. PATENT DOCUMENTS

| | | | | |
|---|---|---|---|---|
| 2011/0266369 | A1* | 11/2011 | Grether | E03C 1/084 239/428.5 |
| 2013/0134235 | A1 | 5/2013 | Blum et al. | |
| 2013/0134239 | A1* | 5/2013 | Blum | E03C 1/084 239/600 |
| 2013/0175366 | A1* | 7/2013 | Zoller | E03C 1/084 239/428.5 |

FOREIGN PATENT DOCUMENTS

| | | |
|---|---|---|
| DE | 102007003296 | 7/2008 |
| DE | 102010048701 | 3/2012 |

* cited by examiner

SANITARY INSERT UNIT

INCORPORATION BY REFERENCE

The following documents are incorporated herein by reference as if fully set forth: U.S. patent application Ser. No. 15/052,093, filed Feb. 24, 2016; and German Patent Application No. 202015001886.6, filed Mar. 9, 2015.

BACKGROUND

The invention relates to a sanitary insert unit with a jet regulator which has a jet regulator housing with a housing inlet and a housing outlet, which jet regulator housing has, in its housing interior, a jet splitter.

Various insert units have already been produced that can be mounted on the water outlet of a sanitary outlet fitting in order to shape the emerging water into a homogeneous, non-sputtering and optionally also sparkling-soft water jet. For this purpose, the previously known insert units have a jet regulator with a jet regulator housing in the interior of which the through-flowing water can be mixed with ambient air. The jet regulator housing of such aerated jet regulators has a housing inlet, connected to the clear conduit cross section on the water outlet of the sanitary outlet fitting, and a housing outlet, wherein the jet regulator housing has, in its housing interior, a jet splitter that can be configured as a pot-shaped diffuser or as a perforated plate. In a jet splitter configured as a pot-shaped diffuser, the pot base serves as an impingement surface where the water flowing onto the jet splitter is deflected outwards. In this case, through-flow openings through which the water can flow are provided in the circumferential wall of the pot shape. The through-flow openings lead into an annular channel, which is formed between the outer circumference of the pot-shaped diffuser and a diffuser ring that engages around the diffuser. In the through-flow openings of the diffuser, and likewise in the annular channel narrowing in the direction of flow, the water flowing through experiences an increase in speed which, in accordance with Bernoulli's equation, results in a negative pressure being generated on the outflow side. Due to this negative pressure, ambient air is sucked in and can pass into the housing interior through aeration openings provided in the circumferential wall of the jet regulator housing. With their jet regulator, the jet regulator housing, the jet splitter located in the jet regulator housing, and with the aeration openings provided in the circumferential wall of the jet regulator housing, the previously known insert units impose a certain installation length, which necessitates a correspondingly long outlet mouthpiece. Since the outlet mouthpiece is generally produced in the outer packing of the outlet fitting, and since colour differences between the outlet fitting and a separately produced outlet mouthpiece are all too noticeable, the production of such an insert unit and of the associated outlet mouthpiece is associated with considerable outlay in manufacturing terms.

SUMMARY

The objective is to make available a sanitary insert unit which is of the type mentioned at the outset and which can be produced and assembled with considerably reduced outlay.

According to the invention, this objective is achieved in particular by the fact that the insert unit has an aerated jet regulator whose jet splitter is configured as a pot-shaped diffuser which has a pot base serving as an impingement surface for deflecting the flow of water outwards and which, in the circumferential wall of its pot shape, has at least one through-flow opening that leads into an annular channel, wherein the jet regulator has, in a circumferential wall of its jet regulator housing, at least one aeration channel, of which the channel outlet opening leads into the housing interior of the jet regulator housing, and wherein the opening edge of the channel outlet opening facing towards the housing outlet is arranged above a cross-sectional plane of the jet regulator housing that extends through the outlet-side front face of the jet splitter.

The sanitary insert unit configured in accordance with the invention has an aerated jet regulator which has a jet regulator housing with a housing inlet and a housing outlet. A jet splitter, which is configured as a pot-shaped diffuser, is provided in the interior of the jet regulator housing. This pot-shaped diffuser has a pot base which serves as an impingement surface for deflecting the flow of water outwards. In the circumferential wall of the pot-shaped diffuser, at least one through-flow opening is provided that leads into an annular channel, wherein the jet regulator has, in a circumferential wall of its jet regulator housing, at least one aeration channel, of which the channel outlet opening leads into the housing interior of the jet regulator housing. The opening edge of the channel outlet opening facing towards the housing outlet is arranged above a cross-sectional plane of the jet regulator housing that extends through the outlet-side front face of the jet splitter. In the jet regulator used in the sanitary insert unit according to the invention, it is thus possible to achieve a marked reduction in the overall height and a considerable reduction in the volume of the mixing chamber arranged downstream from the jet splitter in the direction of flow. In this mixing chamber, the water flowing through the insert unit is mixed with ambient air, after which the resulting aerated water flows out of the housing outlet of the jet regulator into the atmosphere, optionally by way of a flow straightener provided on the outlet side. Since the opening edge of the channel outlet opening of the at least one aeration channel facing towards the housing outlet is arranged above a cross-sectional plane of the jet regulator housing that extends through the outlet-side front face of the jet splitter, the at least one aeration channel in the circumferential wall of the jet regulator housing can be positioned extremely high up in the direction of the housing inlet, such that the bottom edge of the channel opening of the at least one aeration channel is arranged above the lower end of the jet splitter configured as a diffuser. By virtue of the extremely short and compact design of the insert unit according to the invention, only a correspondingly short outlet mouthpiece is needed as well, as a result of which it is possible to considerably reduce the outlay associated with the production of the insert unit, according to the invention, and of its outlet mouthpiece.

In a preferred development according to the invention, provision is made that the opening edge of the channel outlet opening of the at least one aeration channel facing towards the housing outlet is arranged above a cross-sectional plane that extends through the outlet-side channel opening of the annular channel. In this embodiment, the opening edge facing towards the housing inlet, i.e. the opening edge of the channel outlet opening of the at least one aeration channel leading into the housing interior, is even located above a cross-sectional plane that extends through the outlet-side channel opening of the annular channel. This unusual position of the at least one aeration channel ensures that the air sucked into the housing interior is mixed particularly thoroughly and intensively with the water that is accelerated through the preferably conically tapering annular channel. The arrangement of the at least one aeration channel at a high position on the circumferential wall of the jet regulator housing at the same time avoids a situation in which water can spray outwards through the at least one aeration channel and thus prevents further ambient air from being sucked in.

In order to generate a high negative pressure in the area of the mixing chamber adjoining the annular channel, by which ambient air can be sucked into the housing interior through the at least one aeration channel, it is advantageous if the annular channel narrows, at least in a partial area thereof, in the direction of its outlet-side channel opening. In a preferred embodiment according to the invention, provision is made that this annular channel narrows conically towards its outlet-side channel opening.

A further aspect meriting its own protection is that, in the sanitary insert unit of the type mentioned at the outset, the abovementioned object is achieved by the fact that the insert unit has an aerated jet regulator with a jet splitter which is configured as a pot-shaped diffuser which has a pot base serving as an impingement surface for deflecting the flow of water outwards and which, in the circumferential wall of its pot shape, has at least one through-flow opening that leads into an annular channel, wherein the jet splitter protrudes at least in part into a diffuser ring and, between itself and the diffuser ring, delimits the annular channel, wherein the diffuser ring is insertable into an outlet-side housing part of the jet regulator housing until an annular step arranged on the outer circumference of the diffuser ring bears on an inlet-side mating surface on the outer housing part, wherein a circumferential locking cam is provided on the outer circumference of the diffuser ring and can be brought into locking engagement with a locking groove provided on the inner circumference of the outlet-side housing part, and wherein the locking cam has a run-on bevel which interacts with a mating bevel upstream from the locking groove in the insertion direction, which mating bevel has, by comparison with the run-on bevel, a greater angle of inclination with respect to the longitudinal axis of the jet regulator.

In this insert unit according to the invention, which can be realized in addition to or instead of the aspect of the invention already mentioned above, the aerated jet regulator has a jet splitter configured as a pot-shaped diffuser, wherein the pot base of this diffuser serves as an impingement surface for deflecting the flow of water outwards, and wherein at least one through-flow opening is provided in the circumferential wall of the pot shape. This jet splitter configured as a diffuser protrudes at least in part into a diffuser ring which, between itself and the diffuser, delimits the annular channel. The diffuser ring is insertable into an outlet-side housing part of the jet regulator housing until an annular step arranged on the outer circumference of the diffuser ring bears on an inlet-side mating surface on the outlet-side housing part. In order to connect the diffuser ring to the outlet-side housing part in a firm but releasable manner, a circumferential locking cam is provided on the outer circumference of the diffuser ring and can be brought into locking engagement with a locking groove arranged on the inner circumference of the outlet-side housing part. The circumferential locking cam on the outer circumference of the diffuser ring has a run-on bevel which interacts with a mating bevel on the outlet-side housing part upstream from the locking groove in the insertion direction. This mating bevel has, by comparison with the run-on bevel, a greater angle of inclination with respect to the longitudinal axis of the jet regulator. By virtue of this configuration, it is possible for the diffuser ring, on the one hand, and the outlet-side housing part, on the other hand, to be assembled at great speed in an automated production process. As a result of the geometric configuration of run-on bevel and mating bevel, the expansion rate on the outlet-side housing part is not so great as in a configuration with run-in radii, for example. As a result of this lower expansion rate during rapid assembly, it is possible to effectively avoid expansion cracks in the outlet-side housing part during the assembly process, and lower assembly forces are also the result of this limiting locked engagement by hooking or snapping.

In a preferred embodiment according to the invention, the angle of inclination of the mating bevel is between 40° and 50°, while that of the run-on bevel is between 30° and 40°. An embodiment is preferred in which the angle of inclination of the mating bevel is approximately 45° and that of the run-on bevel is approximately 35°.

In a further aspect of the invention which merits its own protection, and which can be realized in addition to or instead of the aspects of the invention described above, the jet regulator is insertable with its jet regulator housing into an outlet mouthpiece that can be mounted on the water outlet of a sanitary outlet fitting, wherein the jet regulator is sealed off axially by a sealing ring that can be clamped between the jet regulator and the outlet-side front edge of the outlet fitting, wherein the jet regulator has, on its inlet-side front face, an annular wall around which the sealing ring engages, and wherein the sealing ring, on the one hand, protrudes beyond the annular wall and, on the other hand, protrudes beyond the inlet-side front edge of the outlet mouthpiece.

In this aspect of the invention, the jet regulator of the insert unit according to the invention is inserted with its jet regulator housing into an outlet mouthpiece that can be mounted on the water outlet of a sanitary outlet fitting. In order to seal off the jet regulator housing from the water outlet of the sanitary outlet fitting, a sealing ring is provided which affords axial sealing and which can be clamped between the jet regulator and the outlet-side front edge of the outlet fitting. The jet regulator now has, on its inlet-side front face, an annular wall around which the sealing ring engages, wherein the sealing ring, on the one hand, protrudes beyond the annular wall and, on the other hand, protrudes beyond the inlet-side front edge of the outlet mouthpiece. Particularly in an especially compact design of the insert unit and of its jet regulator, only a very small installation space is available for the sealing ring that is needed for the axial sealing. Since the sealing ring may have a very slender height to thickness ratio in order to provide a secure hold in the outlet mouthpiece, on the one hand, and on account of a required protrusion from the outlet mouthpiece beyond the norm, there is a danger here of the sealing ring collapsing inwards when the outlet mouthpiece is pulled onto the water outlet of the sanitary outlet fitting, thereby hindering a secure and tight fastening of the outlet mouthpiece and of the insert unit located therein on the water outlet of a sanitary outlet fitting. However, since the jet regulator of the insert unit according to the invention has, on its inlet-side front face, an annular wall around which the sealing ring engages, the annular wall supports the sealing ring against axial buckling in the event of axial compression. The sealing ring can bear with a press fit on the inner circumference of the outlet mouthpiece, such that the sealing ring secures both itself and also the insert unit during the handling associated with assembling the insert unit in the outlet fitting and in particular when handled face down. However, to ensure that the sealing ring can be inserted with a gentle press fit into the outlet mouthpiece, it is expedient if a small air gap or free space remains between the sealing ring and the annular wall protruding upwards counter to the direction of flow.

In a preferred embodiment according to the invention, provision is made that the jet regulator of the insert unit according to the invention has a jet regulator housing with an inlet-side and an outlet-side housing part, that a jet splitter configured as a diffuser or as a perforated plate is insertable into the inlet-side housing part from the direction of the inlet-side front face of the housing, and that the annular wall is arranged on, preferably integrally formed on, the inlet-side front face of the jet splitter.

In a further aspect of the invention meriting its own protection, provision is made that the annular wall engages around a regulator housing of a flow rate regulator and/or around a dome screen or filter screen. If necessary, this flow rate regulator can be connected, on its inlet-side front face, to the dome screen or filter screen. To be able to fasten the flow rate regulator to the inlet side of the insert unit according to the invention in a reliable way but with little effort, it is advantageous if a locking connection is provided between the annular wall and the regulator housing.

The simple production of the insert unit according to the invention is additionally made much easier if the locking connection provided between the annular wall and the regulator housing is arranged at a distance under the free front edge of the annular wall. Thus, the regulator housing of the flow rate regulator can be inserted into the annular wall, wherein a positionally correct arrangement between the regulator housing of the flow rate regulator and the other components of the insert unit is ensured. By further pressure being applied to the flow rate regulator centred in the annular wall, said flow rate regulator can be connected reliably and securely to the other components of the insert unit.

BRIEF DESCRIPTION OF THE DRAWINGS

Developments according to the invention will become clear from the claims in conjunction with the drawings and the description. A preferred embodiment according to the invention is explained in more detail below with reference to the drawing, in which:

DETAILED DESCRIPTION OF THE PREFERRED EMBODIMENTS

Figure 2:
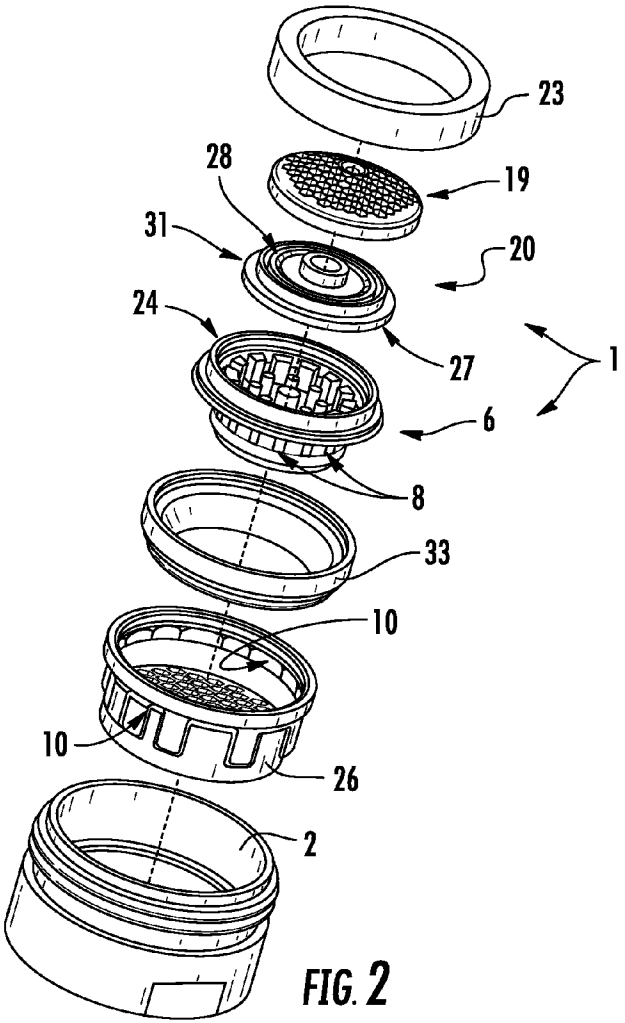
FIG. 2 shows the insert unit from FIG. 1 and its outlet mouthpiece in an exploded perspective view of the component parts.
Figure 1:
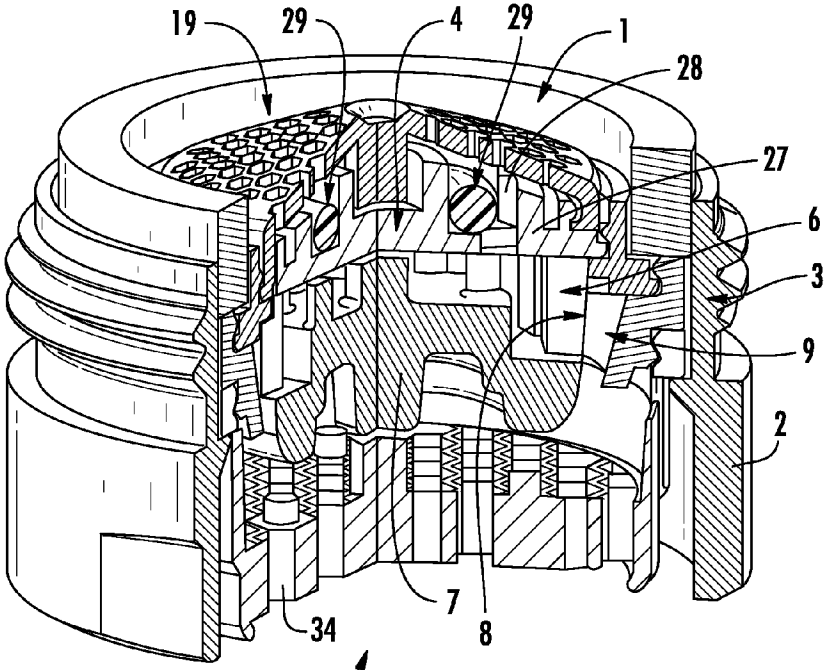
FIG. 1 shows a sanitary insert unit depicted in detail in longitudinal section and inserted into a sleeve-shaped outlet mouthpiece, wherein the insert unit can be mounted by the outlet mouthpiece on the water outlet of a sanitary outlet fitting not shown here.
Figure 4:
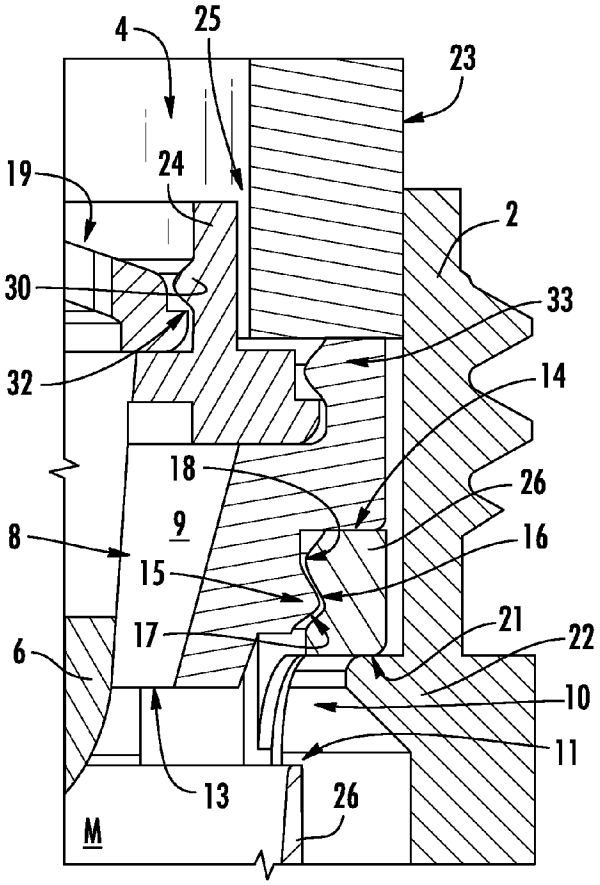
FIG. 4 shows a longitudinal section of a detail of the sanitary insert unit shown in FIG. 3, with the component parts in an enlarged view.
Figure 3:
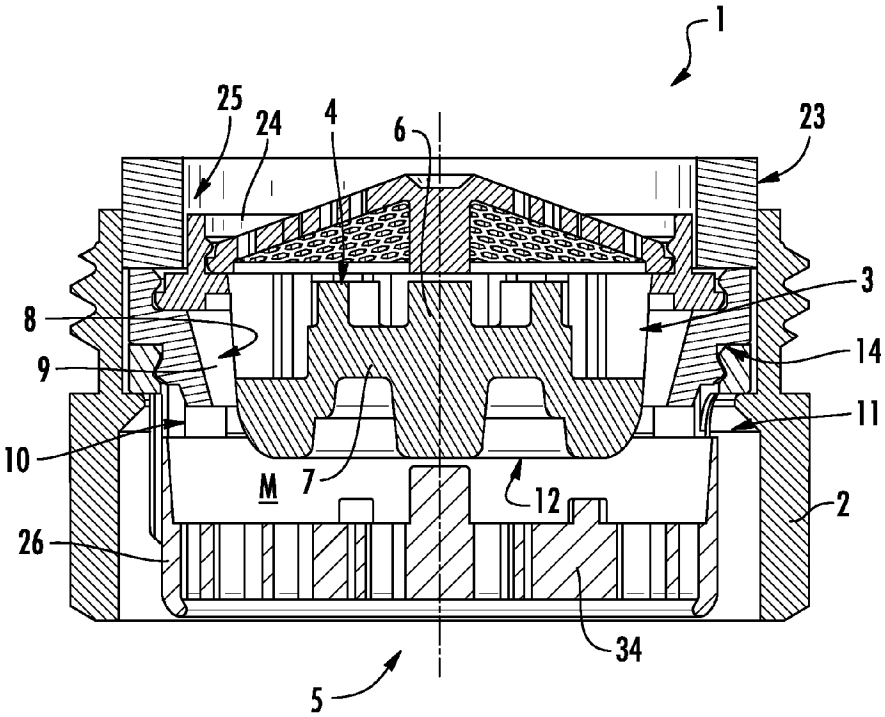
FIG. 3 shows a sanitary insert unit likewise depicted in longitudinal section and inserted in the outlet mouthpiece in a longitudinal side view, although here it does not have a flow rate regulator interposed between dome screen and jet regulator.
Figure 6:
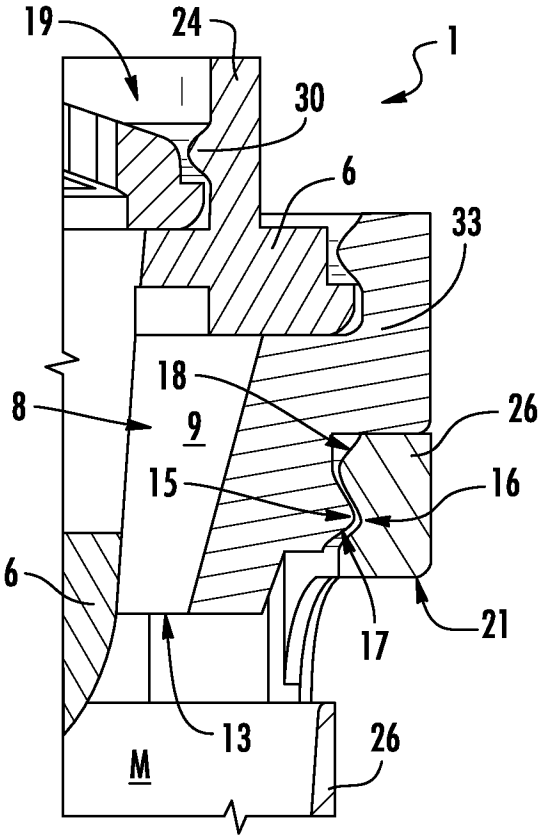
FIG. 6 shows the insert unit from FIGS. 3 to 5 in an exploded perspective view without the associated outlet mouthpiece.
Figure 5:
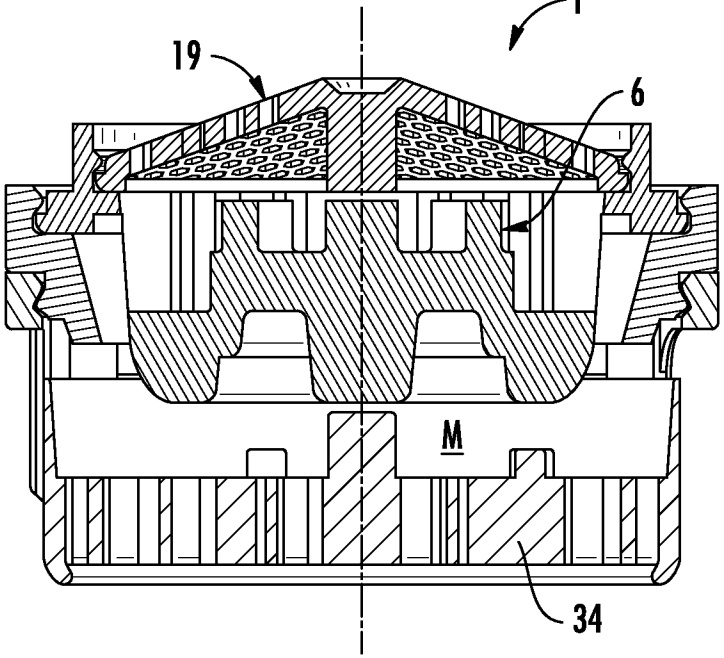
FIG. 5 shows the insert unit from FIGS. 3 and 4 in a perspective longitudinal section.

Two different embodiments of a sanitary insert unit 1 are shown in FIGS. 1 and 2 and in FIGS. 3 to 6. The sanitary insert unit 1 is insertable into a sleeve-shaped outlet mouthpiece 2, which can be mounted on the water outlet of an outlet fitting (not shown here). The sanitary insert unit 1 has a jet regulator 3, which is configured here as an aerated jet regulator. The jet regulator 3 has a jet regulator housing, of which the inlet-side front face forms a housing inlet 4, while the outlet-side front face of the housing is configured as a housing outlet 5. A jet splitter 6, here configured as a pot-shaped diffuser, is provided in the jet regulator housing. This pot-shaped diffuser has a pot base 7, which serves as an impingement surface that deflects the flow of water outwards. The pot-shaped diffuser has, in the circumferential wall of its pot shape, at least one through-flow opening and, as shown here, preferably a plurality of through-flow openings 8 which, in particular, are arranged at uniform intervals and lead into an annular channel 9.

In a circumferential wall of its jet regulator housing, the jet regulator 3 has at least one aeration channel 10, of which the channel outlet opening leads into the housing interior. By way of this at least one aeration channel 10, ambient air can be sucked into the housing interior of the jet regulator housing and, together with the water flowing through there, is shaped into a homogeneous, non-sputtering and in particular also sparkling-soft water jet.

To make the sanitary insert unit 1 and its jet regulator 3 as compact as possible, the opening edge 11 of the channel outlet opening of the at least one aeration channel 10 facing towards the housing outlet 5 is arranged above a cross-sectional plane of the jet regulator housing that extends through the outlet-side front face 12 of the jet splitter 6. In this way, it is possible to substantially reduce the overall height of the mixing chamber M, which follows the annular channel 9 in the direction of flow and in which the water mixed with ambient air is prepared. Here, the at least one aeration channel 10 is positioned in the direction of the housing inlet 4 in such a way that the opening edge 11 of the channel outlet opening of the at least one aeration channel 10 facing towards the housing outlet 5 is arranged above a cross-sectional plane that extends through the outlet-side channel opening 13 of the annular channel 9. By virtue of this arrangement of the aeration channels 10 and of their channel outlet openings, in which arrangement the channel wall outwardly delimiting the annular channel 9 covers the channel outlet openings of the aeration channels 10 in areas, it is possible to achieve particularly good and intensive mixing of the air, sucked into the housing interior of the jet regulator housing, and the water, accelerated in the annular channel 9. By thus arranging the aeration channels 10 high up in the direction of the housing inlet 4, it is possible to avoid a situation in which the water mixed with ambient air splashes outwards and thus prevents further air from being sucked in.

As becomes clear from a comparison of FIGS. 1 to 6, the jet splitter 6 protrudes at least in part into a diffuser ring 33 which, between itself and the jet splitter 6, delimits the annular channel 9. The diffuser ring 33, which is here also configured as the inlet-side housing part of a substantially two-part jet regulator housing, is insertable into an outlet-side housing part 26 of the jet regulator housing until an annular step 14 arranged on the outer circumference of the diffuser ring 33 bears on an inlet-side mating surface on the outlet-side housing part 26. A circumferential locking cam 15 is provided on the outer circumference of the diffuser ring 33 and can be brought into locking engagement with a locking groove 16 provided on the inner circumference of the outlet-side housing part 26. The locking cam 15 has a run-on bevel 17 which interacts with a mating bevel 18 upstream from the locking groove 16 in the insertion direction.

The mating bevel 18 on the outlet-side housing part 26 has, by comparison with the run-on bevel 17 on the locking cam 15 of the diffuser ring 33, a greater angle of inclination with respect to the longitudinal axis of the jet regulator. By virtue of these different angles of inclination of run-on bevel 17 and mating bevel 18, it is possible for the diffuser ring 33 and the outlet-side housing part 26 to be assembled at great speed, possibly also in an automated production and assembly process. As a result of the chosen geometric configuration of the run-on bevel 17 and of the corresponding mating bevel 18, the expansion rate on the outlet-side housing part 26 is not so great as in a configuration with run-in radii, for example. As a result of this lower expansion rate, it is possible to effectively avoid expansion cracks on the outlet-side housing part 26 during the assembly process, even in the case of rapid assembly; at the same time, lower assembly forces are also sufficient for the locking connection provided between the diffuser ring 33 and the outlet-side housing part 26. While the angle of inclination of the mating bevel 18 preferably measures approximately 45°, the run-on bevel 17 has, by contrast, an angle of inclination of approximately 35° with respect to the longitudinal axis of the jet regulator.

As can be seen from FIGS. 1 to 6, a preferably conically shaped dome screen or filter screen 19 is arranged upstream from the jet regulator 3. As can be seen from the illustrative embodiment shown in FIGS. 1 and 2, a flow rate regulator 20 can be arranged between the dome screen or filter screen 19 and the jet regulator 3, the purpose of the flow rate regulator 20 being to adjust the volume of water flowing through the jet regulator 3 per unit of time to a defined pressure-independent value.

The jet regulator 3 is insertable with its jet regulator housing into an outlet mouthpiece 2 that can be mounted on the water outlet of a sanitary outlet unit. The jet regulator is inserted into the outlet mouthpiece 2 from the direction of the inlet-side front face until an annular step 21 arranged on the outer circumference of the jet regulator housing bears on an annular step 22 arranged on the inner circumference of the sleeve-shaped outlet mouthpiece 2. The jet regulator 3 is sealed off axially by a sealing ring 23, which can be clamped between the jet regulator 3 and the outlet-side front edge of the outlet fitting. Given the compact design that is sought for the jet regulator 3, and on account of the limited installation space on the inlet side of the jet regulator 3 as a result of the dome screen or filter screen 19 and the flow rate regulator 20, only a very small space is available for the sealing ring that is needed for the axial sealing. Since this sealing ring 23 may have a very slender height to thickness ratio in order to provide a secure hold in the outlet mouthpiece 2, and possibly also on account of a required protrusion beyond the norm, there is a danger of the sealing ring 23 collapsing inwards when the outlet mouthpiece 2 is pulled on, thereby hindering a secure and tight fastening of the jet regulator 3 on the water outlet of the sanitary outlet fitting. Therefore, on its inlet-side front face, the jet regulator 3 has an annular wall 24 around which the sealing ring 23 engages, wherein the sealing ring 23, on the one hand, protrudes beyond the annular wall 24 and, on the other hand, protrudes beyond the inlet-side front edge of the outlet mouthpiece 2. In the event of axial compression, the annular wall 24 supports the sealing ring 23, here configured as a flat seal, against axial buckling. The sealing ring 23 bears with a press fit on the inner circumference of the outlet mouthpiece 2, such that the sealing ring 23 secures both itself and also the jet regulator 3, for example if the sanitary insert unit has to be mounted in particular face down on the water outlet of the sanitary outlet fitting. However, to ensure that the sealing ring 23 can be inserted with a gentle press fit into the outlet mouthpiece 2, it is advantageous if an air gap 25 remains between the sealing ring 23 and the surrounding annular wall 24 protruding counter to the direction of flow.

The jet regulator housing of the jet regulator 3 is configured in two parts here, having the diffuser ring 33, which also serves as an inlet-side housing part here, and an outlet-side housing part 26. The jet splitter 6 configured as a diffuser is insertable into the diffuser ring 33, also serving as an inlet-side housing part, from the direction of the inlet-side front face of the housing. The annular wall 24 is formed integrally on the inlet-side front face of the jet splitter 6 here configured as a diffuser. As is clear from the longitudinal sections according to FIGS. 1 and 2, the annular wall 24 engages around a regulator housing 27 of a flow rate regulator 20. At least one annular channel is provided in the regulator housing 27 of the flow rate regulator 20, in which annular channel an annular flow restrictor 29 is located which, between itself and a regulating profile arranged on an inner and/or outer channel wall, delimits a control gap which can be modified, in terms of its clear gap cross section, by the flow restrictor deforming under the pressure of the water flowing through.

As is clear from a comparison of FIGS. 1 and 2, on the one hand, and of FIGS. 3 to 6, on the other hand, a dome screen or filter screen 19 and, optionally, in addition to or instead of the latter, the flow rate regulator 20 can be inserted into the free space delimited by the annular wall 24. In order to hold the dome screen or filter screen 19 and optionally the flow rate regulator 20 securely in the free space delimited by the annular wall 24, a locking cam 30 is provided on the inner circumference of the annular wall 24. This locking cam 30 engages behind an annular flange 31, 32 arranged on the outer circumference of the regulator housing 27 or on the outer circumference of the dome screen or filter screen 19. Since the locking cam 30 provided on the inner circumference of the annular wall 24 is arranged at a distance from the free front edge of the annular wall 24, the wall portion of the annular wall 24 remaining between the locking cam 30 and the free front edge of the annular wall 24 forms a centring aid, which substantially facilitates the locking of the regulator housing 27 or of the dome screen or filter screen 19 on the locking cam 30 and also the locking of the dome screen 19 on the regulator housing 27 already in locking engagement with the annular wall 24. The axial spacing of the locking cam 30 from the inlet-side front edge of the annular wall 24 permits an axial extent in which the dome screen or filter screen 19, or the combination consisting of dome screen 19 and flow rate regulator 20, can be imposed during assembly, wherein the applied component centres itself in advance on account of the shape of the locking cam 30 and the rounding on the circumferential outlet-side bottom edge of the dome screen or filter screen 19 or on the similarly rounded circumferential bottom edge of the regulator housing 27. This greatly facilitates the process of assembling the dome screen or filter screen 19, or the combination consisting of the dome screen 19 and the flow rate regulator 20, on the jet splitter 6 configured as a diffuser, wherein an axial mounting force simply has to be applied for the locking engagement, without at the same time having to take care of the centring and orientation of the components that are to be connected to each other.

A flow straightener is integrally formed on the outlet-side front face of the jet regulator housing so as to provide a lattice structure or mesh structure that guides the flow.

LIST OF REFERENCE SIGNS

1 sanitary insert unit
2 outlet mouthpiece
3 jet regulator
4 housing inlet
5 housing outlet
6 jet splitter
7 pot base
8 through-flow opening
9 annular channel
10 aeration channel
11 opening edge
12 front face
13 channel opening
14 annular step
15 locking cam
16 locking groove
17 run-on bevel
18 mating bevel
19 dome screen or filter screen
20 flow rate regulator
21 annular step
22 annular step
23 sealing ring
24 annular wall
25 air gap
26 outlet-side housing part
27 regulator housing
28 regulator profile
29 flow restrictor
30 locking cam
31 annular flange
32 annular flange
33 diffuser ring
34 flow straightener
M mixing zone

The invention claimed is:

1. A sanitary insert unit (1) comprising an aerated jet regulator (3) which has a jet regulator housing with a housing inlet (4), a housing outlet (5), and a jet splitter (6) in a housing interior of said jet regulator housing, the jet splitter (6) protrudes at least in part into a diffuser ring (33) and, between the jet splitter and the diffuser ring (33), delimits an annular channel (9), the diffuser ring (33) is insertable into an outlet-side housing part (14) of the jet regulator housing until an annular step (14) arranged on an outer circumference of the diffuser ring (33) bears on an inlet-side mating surface on the outlet-side housing part, a circumferential locking cam (15) is provided on the outer circumference of the diffuser ring (33) and is movable into locking engagement with a locking groove (16) provided on an inner circumference of the outlet-side housing part (26), and the locking cam (15) has a run-on bevel (17) which interacts with a mating bevel (18) upstream from the locking groove (16) in an insertion direction, said mating bevel (18) has a greater angle of inclination with respect to a longitudinal axis of the jet regulator in comparison with the run-on bevel (17), wherein the jet regulator (3) is insertable with said jet regulator housing into an outlet mouthpiece (2) that is mountable on a water outlet of a sanitary outlet fitting, the jet regulator (3) is sealed off axially by a sealing ring (23) that is clampable between the jet regulator (3) and an outlet-side front edge of the outlet fitting, the jet regulator has, on an inlet-side front face, an annular wall (24) around which the sealing ring (23) engages, and the sealing ring (23), on the one hand, protrudes beyond the annular wall (24) and, on the other hand, protrudes beyond an inlet-side front edge of the outlet mouthpiece (2).

2. The sanitary insert unit according to claim 1, wherein an angle of inclination of the mating bevel (18) is between 40° and 50° and an angle of inclination of the run-on bevel (17) is between 30° and 39°.

3. The sanitary insert unit according to claim 2, wherein the angle of inclination of the mating bevel (18) is approximately 45° and the angle of inclination of the run-on bevel (17) is approximately 35°.

4. The sanitary insert unit according to claim 1, wherein the annular channel (9) narrows, at least in a partial area thereof, in a direction of an outlet-side channel opening thereof.

5. The sanitary insert unit according to claim 1, wherein the jet regulator comprises said jet regulator housing with an inlet-side and the outlet-side housing part (26), the jet splitter (6) is configured as a diffuser or as a perforated plate and insertable into the inlet-side housing part from a direction of the inlet-side front face of the housing, and the annular wall (24) is arranged on an inlet-side front face of the jet splitter (6).

6. The sanitary insert unit according to claim 1, wherein the annular wall (24) engages around a regulator housing (27) of a flow rate regulator (20).

7. The sanitary insert unit according to claim 6, wherein the flow rate regulator (20) is connected, on an inlet-side front face thereof, to a dome screen or filter screen (19).

8. The sanitary insert unit according to claim 6, further comprising a locking connection provided between the annular wall (24) and the regulator housing (27).

* * * * *